US010231519B2

(12) United States Patent
Fildan et al.

(10) Patent No.: US 10,231,519 B2
(45) Date of Patent: Mar. 19, 2019

(54) LOCKING GARMENT FASTENER

(71) Applicants: Gerhard Fildan, Vienna (AT); Karl Wanzenböck, Teesdorf (AT)

(72) Inventors: Gerhard Fildan, Vienna (AT); Karl Wanzenböck, Teesdorf (AT)

(73) Assignee: Dubrosky & Tracy Patent Service Corp., Central (HK)

( * ) Notice: Subject to any disclaimer, the term of this patent is extended or adjusted under 35 U.S.C. 154(b) by 179 days.

(21) Appl. No.: 15/390,242

(22) Filed: Dec. 23, 2016

(65) Prior Publication Data

US 2018/0160779 A1 Jun. 14, 2018

Related U.S. Application Data

(63) Continuation-in-part of application No. 15/374,317, filed on Dec. 9, 2016, now Pat. No. 10,136,690.

(51) Int. Cl.

| | |
|---|---|
| ***A44B 11/25*** | (2006.01) |
| ***A41F 1/00*** | (2006.01) |
| ***A44B 17/00*** | (2006.01) |

(52) U.S. Cl.

CPC ..... *A44B 11/2588* (2013.01); *A41F 1/00* (2013.01); *A44B 17/00* (2013.01)

(58) Field of Classification Search

CPC ..... A41F 1/00; A44B 11/2588; A44B 17/00
See application file for complete search history.

(56) References Cited

U.S. PATENT DOCUMENTS

| | | | | |
|---|---|---|---|---|
| 4,633,549 A * | 1/1987 | Lovato | ..... | A44B 11/2592 24/615 |
| 6,412,153 B1 * | 7/2002 | Khachadourian | ..... | F16B 5/0664 24/614 |
| 6,640,400 B1 * | 11/2003 | Chen | ..... | A45C 13/1076 190/18 A |

* cited by examiner

*Primary Examiner* — Victor D Batson
*Assistant Examiner* — David M Upchurch
(74) *Attorney, Agent, or Firm* — Kitner IP, LLC; Mary Frances Ludwig

(57) ABSTRACT

A fastener for a garment, particularly suited to use in a garment such as a brassiere, includes female and male parts that interlock. The female part is connected to a first garment piece and the male part is connected to a second garment piece. The fastener is an overlapping fastener of the type in which the male piece is engaged with the female piece by inserting a connector plate of a male part into an aperture of a female part at an angle and thereafter pivoting the male part relative the female part thereby snap-fitting the connector plate in place in the aperture. The female part has a socket for receiving a detent of the male part, forming a locking mechanism. Dimensioning the male part to interfere with an edge of the female when coupling creates a second locking mechanism, as the female part resiliently couples to the male.

15 Claims, 4 Drawing Sheets

LOCKING GARMENT FASTENER

CROSS REFERENCE TO RELATED APPLICATION

This application is a Continuation-In-Part of and claims the filing benefit under 35 U.S.C. § 120 of application Ser. No. 15/374,317, filed 9 Dec. 2016, which claims a right of priority under 35 U.S.C. § 119 from United Kingdom patent application 1521710.2, filed on 9 Dec. 2015, both of which are hereby incorporated by reference.

TECHNICAL FIELD

This invention relates to a fastener for a garment. More particularly, the invention relates to a locking fastener particularly suited to use in a garment such as a brassiere.

BACKGROUND OF THE INVENTION

There are numerous disparate types of fastener in use today. One particularly successful fastener is described in U.S. Pat. No. 6,793,556 in the name of Fildan Accessories Corporation and having the same inventor(s) as the present application. U.S. Pat. No. 6,793,556 describes a front closure for a fastener that is slim, lightweight, practically invisible from the outside of the garment, and that may be incorporated into a brassiere with relative ease. Although very successful and effective, there are improvements that could be made to such a fastener.

For example, although the fastener described in U.S. Pat. No. 6,793,556 is ideally suited as a front closure for a brassiere, it is not particularly suited to many other closure applications, such as a strap fastener for a bra, bikini, or top with interchangeable straps. This is due to the fact that the tensile stress rating of the known fastener is typically much less than 10 kgs and is insufficient for the other purposes. Accordingly, if interchangeable straps are to be provided, a second, different type of fastener must also be used in the garment. This is inconvenient and inefficient from a manufacturing standpoint and may result in an increase in the manufacturing cost of the garment. This could be avoided if the tensile stress rating of the fastener could be increased to a level suitable for use with interchangeable straps as well as front fasteners.

Furthermore, inadvertent release of a fastener can be a source of inconvenience and embarrassment. Irrespective of the benefits of opening up new markets and simplifying manufacturing by increasing the tensile stress rating of the fastener, it is also advantageous to increase the tensile stress rating in any event as it will decrease the likelihood of the fastener becoming inadvertently undone.

In some garments it is desirable to attach the fastener in a reverse orientation, with the closure mechanism against the body of the wearer. This approach provides a very smooth garment appearance, especially when the fastener is sewn or welded to the garment fabric via a thin flap on the fastener ends. However, when the closure mechanism is worn against the skin, a slight motion between the male and female parts may pinch the wearer's skin or hair, causing discomfort.

It is an object of the present invention to provide a fastener that includes locking mechanisms to increase tensile strength and prevent motion between the male and female parts when the fastener is coupled.

BRIEF SUMMARY OF THE INVENTION

The present invention is directed to a locking garment fastener which provides increased tensile strength and restricts play between the male and female parts of the fastener when coupled. In accordance with an embodiment, the locking garment fastener comprises:

a female part comprising a female base plate for securing the female part to the first garment piece, and an overlapping connector loop mounted on the female base plate and offset relative thereto, the connector loop defining an elongate aperture therein, the aperture having a roofed portion which overlaps and is roofed in by the female base plate and an open mouth which extends beyond the female base plate;

a male part comprising a male base plate for securing the male part to the second garment piece, an overlapping connector plate mounted on the male base plate and offset relative thereto, the connector plate having a rear face, a trailing abutment edge, and an interior side, the connector plate being dimensioned for insertion and retention in the elongate aperture in the female part, and a recess in the male base plate surrounding the portion of the connector plate overlapped by the male base plate;

the connector plate, the open mouth, and the elongate aperture of the connector loop being dimensioned so that insertion of the connector plate into the elongate aperture must be realized by positioning the male part at an inclined orientation relative to the female part before inserting the connector plate into the open mouth of the elongate aperture and bringing the male part and the female part together, retention of the connector plate in the elongate aperture of the connector loop being realized by snap fitting the connector plate in place by pivoting the fully inserted connector plate from the inclined orientation to a substantially co-planar orientation of the male base plate and the female base plate using the roofed portion of the aperture as a fulcrum until the abutment edge snaps into position in the aperture, and release of the connector plate from the aperture is realized by pivoting the inserted male part from the substantially co-planar orientation back to the inclined orientation using the roofed portion of the aperture as a fulcrum to release the abutment edge from the aperture before moving the male part and the female part apart;

the connector plate having a detent protruding from the interior side; and, the female part having a socket configured to receive the detent when the male part and the female part are pivoted to a substantially co-planar orientation, thereby locking the male part to the female part.

In accordance with another embodiment, the detent is centrally located on the interior side of the connector plate and protrudes away from the male base plate along a portion of the interior side adjacent the rear face. The elongate aperture has a roofed edge where the connector loop overlaps the female base plate. The socket is coincident with the roofed edge and extends forward into the connector loop, and the portion of the connector loop forward of the socket is configured to retain the detent within the socket.

In accordance with another embodiment, a cavity in the rear face of the connector plate is adjacent the detent and opens toward the male base plate.

In accordance with another embodiment, there are two notches in the interior side of the connector plate. One notch is located above and adjacent to the detent and one notch located below and adjacent to the detent. The notches extend forward from the rear face.

In accordance with another embodiment, the elongate aperture has a leading side which is inclined toward the female base plate, so that the open mouth narrows toward the female base plate. The connector plate has an exterior side intermediate the abutment edge and the male base plate, and the exterior side inclined away from the male base plate, so that the connector plate narrows toward the male base plate. The exterior side of the connector plate is dimensioned to interfere with the leading side of the elongate aperture when the connector plate is in the inclined orientation and positioned within the open mouth. The connector loop is configured to resiliently receive the connector plate when the male base plate is forcibly positioned into the substantially co-planar orientation with the female base plate.

In accordance with another embodiment, each of the male base plate and the female base plate has an opening for reception of the first or second garment piece. In another embodiment, each of the male base plate and the female base includes a longitudinally extending hinge joint suitable for attaching a garment piece to a thin flap.

Other embodiments, in addition to the embodiments enumerated above, will become apparent from the following detailed description, taken in conjunction with the accompanying drawings, which illustrate, by way of example, the principles of the fastener and garment incorporating same.

LIST OF DRAWING REFERENCE NUMERALS

Figure 1:
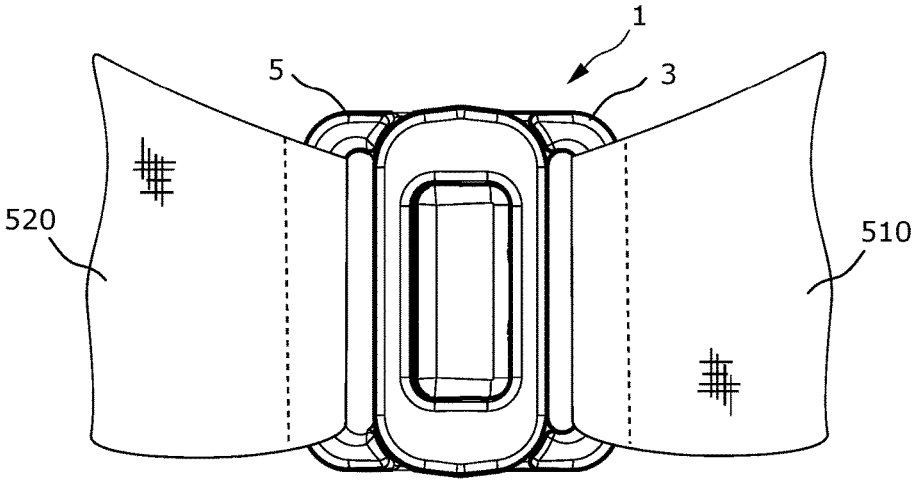
FIG. 1 is a reduced partial front elevation view of a locking garment fastener connected to a garment.

1 fastener
3 female part
5 male part
7 female base plate
8 opening
9 connector loop
11 elongate aperture
12 roofed edge
13 roofed portion
15 open mouth
17 male base plate
19 connector plate
20 rear face
21 abutment edge
22 interior side
23 recess
25 exterior side
27 leading side
33 flap
37 hinge joint
41 detent
43 socket
45 cavity
47 notch
510 first garment piece
520 second garment piece

DETAILED DESCRIPTION OF THE INVENTION

Figure 2:
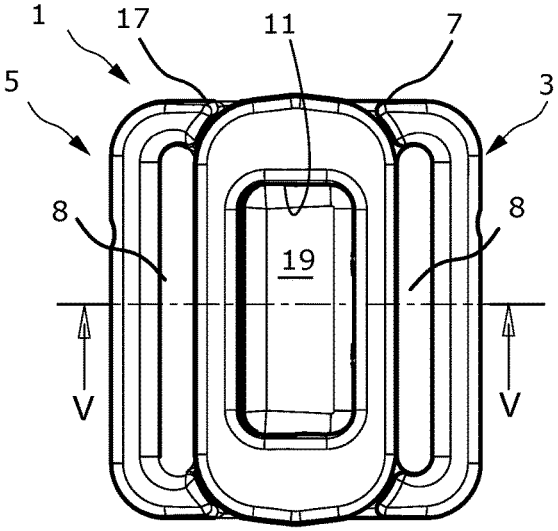
FIG. 2 is a front elevation view of the fastener.
Figure 3:
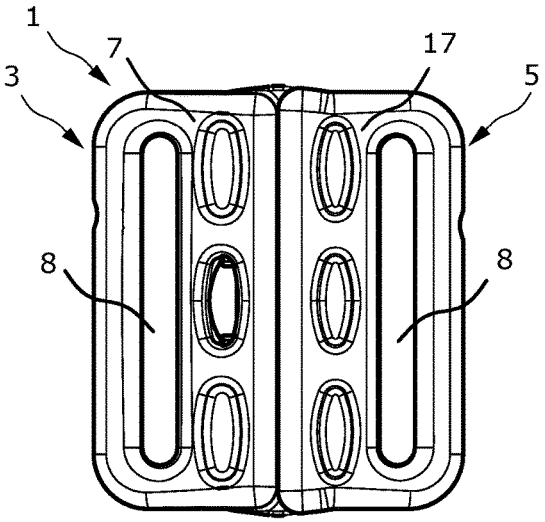
FIG. 3 is a rear elevation view of the fastener.
Figure 5:
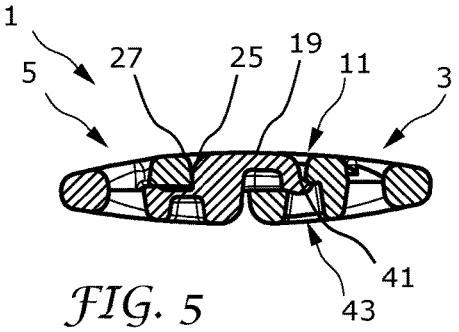
FIG. 5 is a cross sectional view along the line V-V of FIG. 2.
Figure 4:
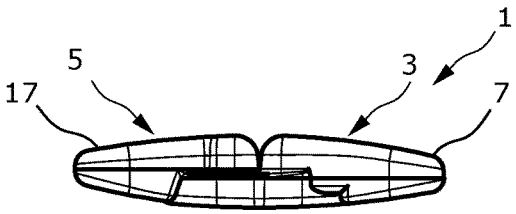
FIG. 4 is a top plan view of the fastener, the bottom plan view being inverted top to bottom.

Referring initially to FIGS. 1-5, there is shown a fastener, indicated generally by the reference numeral 1, comprising a female part 3 and a male part 5 that interlock together. In. FIG. 1, female part 3 is connected to a first garment piece 510 and male part 5 is connected to a second garment piece 520. The female and male parts, when joined together, by extension connect the first and second garment pieces together. FIGS. 2-4 are front elevation, rear elevation, and top plan views, respectively, of fastener 1 in a closed position. FIG. 5 is a cross sectional view along the line V-V of FIG. 2.

FIGS. 6-10 are front and rear elevation, right side, and front and rear perspective views, respectively, of male part 5 of the fastener. Male part 5 includes a male base plate 17 for securing male part 5 to second garment piece 520 (see FIG. 1) and an overlapping connector plate 19 mounted on male base plate 17 and offset relative thereto. In the shown embodiment, male base plate 17 has an opening 8 for reception of the second garment piece. Connector plate 19 is dimensioned for insertion and retention in an elongate aperture 11 in female part 3 (see FIGS. 2 & 5). Connector plate 19 has a rear face 20, an interior side 22, and a trailing abutment edge 21, the operation of which is described in more detail below. A recess 23 in the male base plate 17 surrounds the portion of connector plate 19 which is overlapped by male base plate 17. Recess 23 is semi-elliptical or semi-oval in shape. This recess has the direct effect of substantially increasing the tensile strength rating of the fastener 1. Connector plate 19 has a detent 41 protruding from interior side 22.

Figure 16:
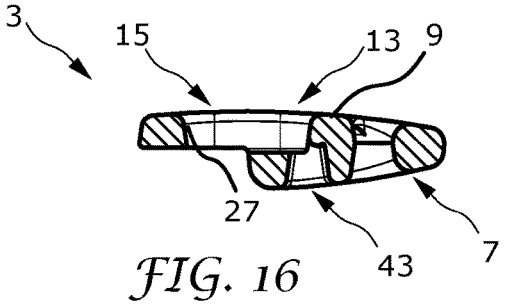
FIG. 16 is a cross sectional view along the line XVI-XVI of FIG. 12.
Figure 14:
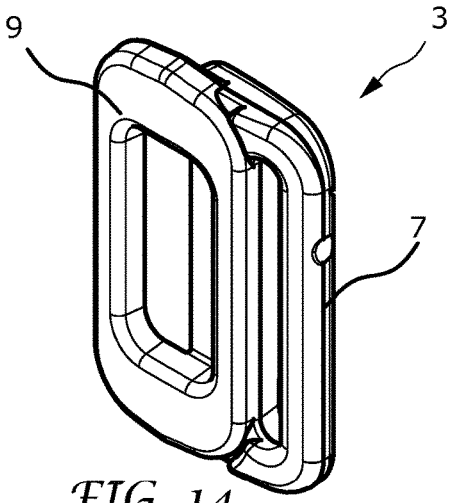
FIG. 14 is a front perspective view of the female part.

FIGS. 12-15 are front and rear elevation and front and rear perspective views, respectively, of female part 3 of the fastener. FIG. 16 is a cross sectional view along the line XVI-XVI of FIG. 12. Female part 3 includes a female base plate 7 for securing female part 3 to first garment piece 510 (see FIG. 1), and an overlapping connector loop 9 mounted on female base plate 7 and offset relative thereto. Connector loop 9 defines an elongate aperture 11 therein, a roofed portion 13 of which overlaps and is roofed in by female base plate 7, and an open mouth 15 of which extends beyond female base plate 7. A socket 43 is configured to receive detent 41 when male part 5 and female part 3 are coupled, thereby locking the male part to the female part. In the shown embodiment, female base plate 7 has an opening 8 for reception of the first garment piece.

Connector plate 19 of the male part, open mouth 15, and elongate aperture 11 of connector loop 9 are dimensioned so that insertion of connector plate 19 into aperture 11 must be realized by positioning male part 5 at an inclined orientation relative to female part 3 before inserting connector plate 19 into open mouth 15 of aperture 11 and bringing male part 5 and female part 3 together. Retention of connector plate 19 in aperture 11 is realized by snap fitting connector plate 19 into place by pivoting the fully inserted connector plate 19 from the inclined orientation to a substantially co-planar orientation of the male base plate 17 and the female base plate 7 (refer also to FIGS. 17A-B). This pivoting motion is achieved by using roofed portion 13 of aperture 11 as a fulcrum until abutment edge 21 of connector plate 19 snaps into position in aperture 11. The release of connector plate 19 from aperture 11 is realized by pivoting inserted male part 5 from the substantially co-planar orientation back to the inclined orientation using roofed portion 13 of aperture 11 as a fulcrum to release abutment edge 21 from aperture 11 before moving male part 5 and female part 3 apart.

Detent 41 and socket 43 provide a locking mechanism, which resists movement of the male and female parts when the fastener is closed. The connection of detent 41 and socket 43 is best shown in FIG. 5. In the shown embodiment, detent 41 is centrally located on interior side 22 of connector plate 19 (see FIGS. 6-10). Detent 41 protrudes away from male base plate 17 along a portion of interior side 22 adjacent rear face 20. Stated another way, detent 41 has a thickness less than the thickness of connector plate 19, and is aligned in the rear with rear face 20.

Figure 12:
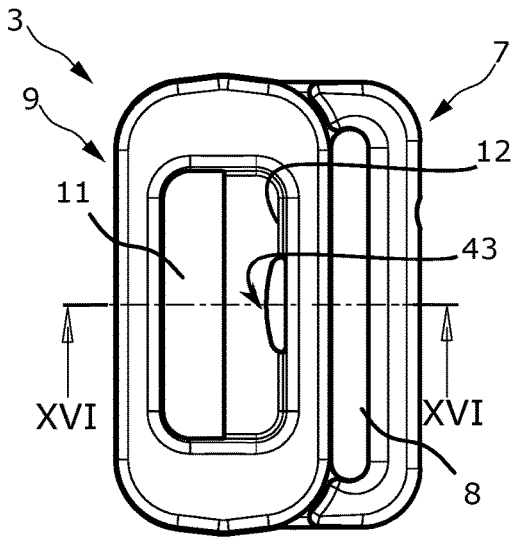
FIG. 12 is a front elevation view of a female part of the fastener.
Figure 13:
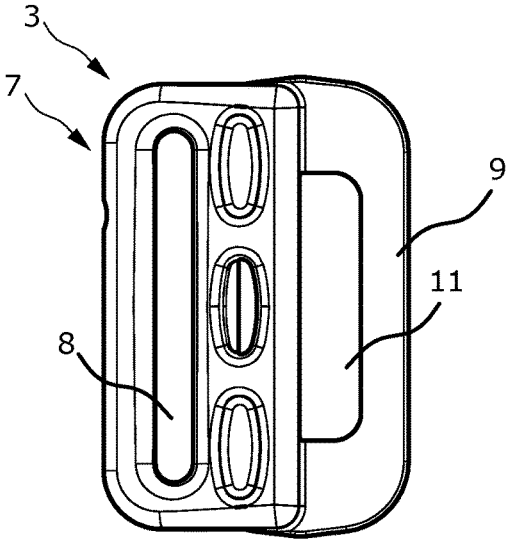
FIG. 13 is a rear elevation view of the female part.

Elongate aperture 11 has a roofed edge 12 where connector loop 9 overlaps female base plate 7 (see FIG. 12). Socket 43 is coincident with roofed edge 12 and extends forward into connector loop 9 (see FIG. 16). The portion of connector loop 9 forward of socket 43 is configured to retain detent 41 within socket 43. When male part 5 is inserted into female part 3 and pivoted to a co-planar orientation, detent 41 snaps into socket 43, locking the fastener. This snapping may produce an audible click.

In one embodiment, rear face 20 of connector plate 19 has a cavity 45 (see FIGS. 7, 10, 11A &11B). Cavity 45 is adjacent detent 41 and opens toward male base plate 17. Cavity 45 permits improved function of the locking mechanism of detent 41, as detent 41 may resiliently bend into the cavity when the male part and female part are being coupled.

Figure 8:
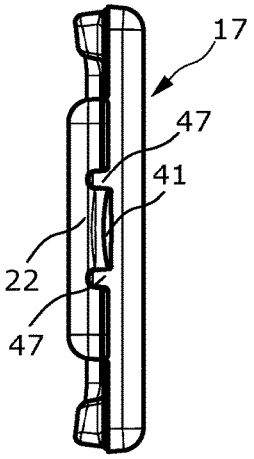
FIG. 8 is a right side view of the male part.
Figure 7:
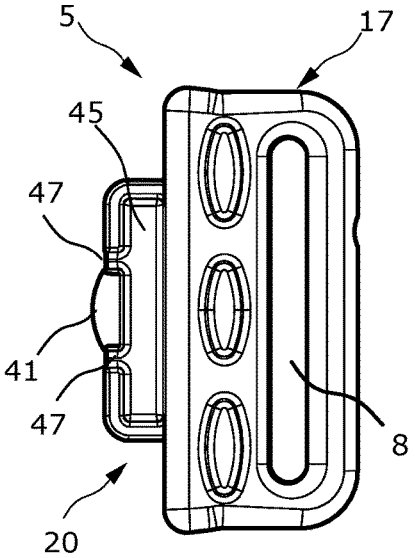
FIG. 7 is a rear elevation view of the male part.
Figure 9:
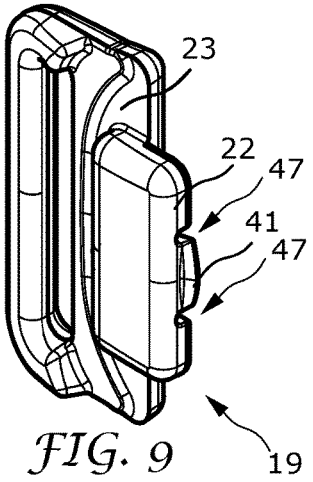
FIG. 9 is a front perspective view of the male part.

In an embodiment, interior side 22 of connector plate 19 includes two notches 47 extending forward from rear face 20 (see FIGS. 7-9). One of the notches 47 is located above and adjacent to detent 41 and the other notch 47 is located below and adjacent to detent 41. Notches 47 improve the snapping function of detent 41, by allowing detent to be closely coupled to socket 43 and increasing freedom of detent 41 to bend while coupling.

Figure 6:
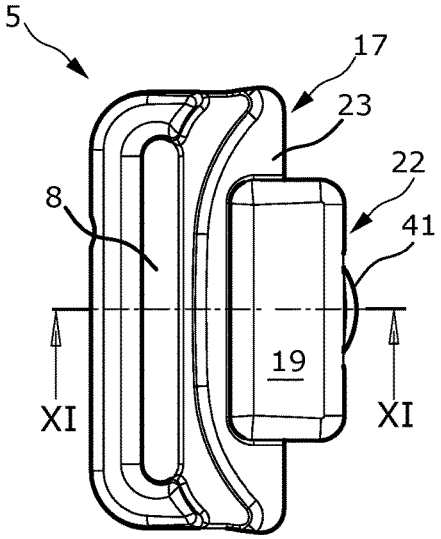
FIG. 6 is a front elevation view of a male part of the fastener.
Figure 11A:
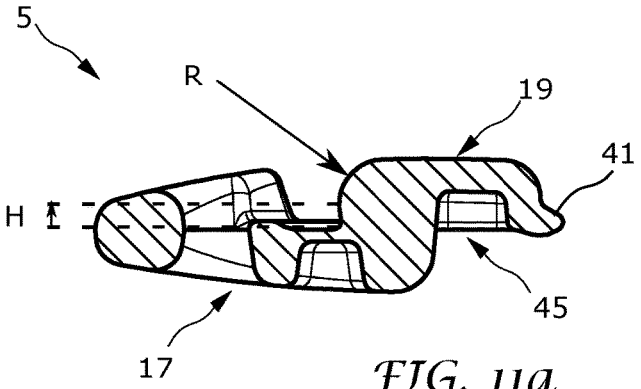
FIGS. 11A & 11B are enlarged cross sectional views of two embodiments of the male part generally along the line XI-XI of FIG. 6.
Figure 11B:
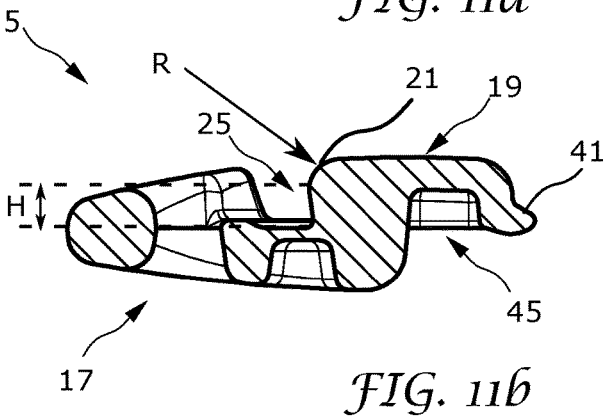
Figure 10:
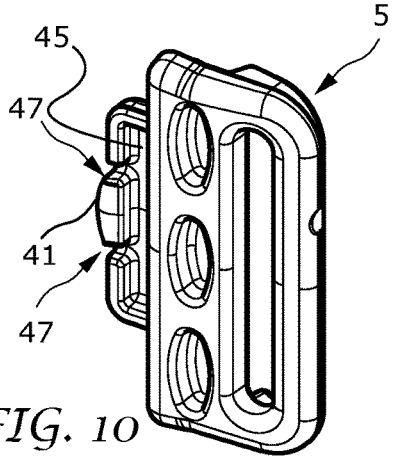
FIG. 10 is a rear perspective view of the male part.

FIGS. 11A & 11B are enlarged cross sectional views of two embodiments of male part 5 taken generally along the line XI-XI of FIG. 6. As seen in FIG. 16, elongate aperture 11 has a leading side 27 which is inclined toward female base plate 7. The inclination of leading side 27 causes open mouth 15 to narrow toward female base plate 7. In male parts 5 of both FIGS. 11A and 11B, connector plate 19 has an exterior side 25 intermediate abutment edge 21 and male base plate 17. Exterior side 25 is inclined away from male base plate 17, so that connector plate 19 narrows toward male base plate 17 and widens toward the abutment edge 21. The inclination of exterior side 25 increases the tensile strength rating of connector plate 19, as the configuration of the connector plate acts to resist dislodgement of the connector plate from the aperture under an applied tensile force. The inclination of leading side 27 of elongate aperture 11 co-operates with the inclination of connector plate 19 to further resist such dislodgement. This cooperation is further illustrated in FIG. 5.

Figure 17A:
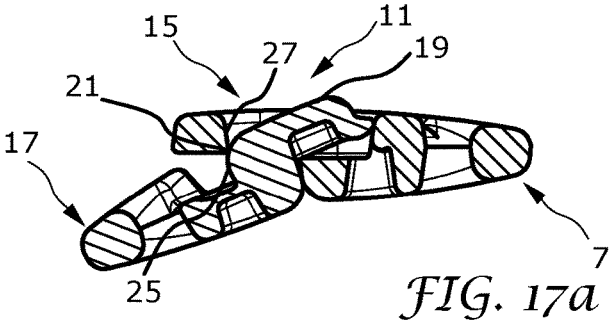
FIGS. 17A & 17B are enlarged cross sectional views of the mart part embodiments of FIGS. 11A & 11B, respectively, partially engaged with the female part of FIG. 16.
Figure 17B:
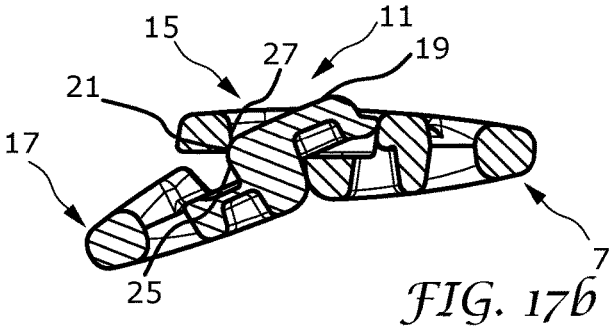
Figure 15:
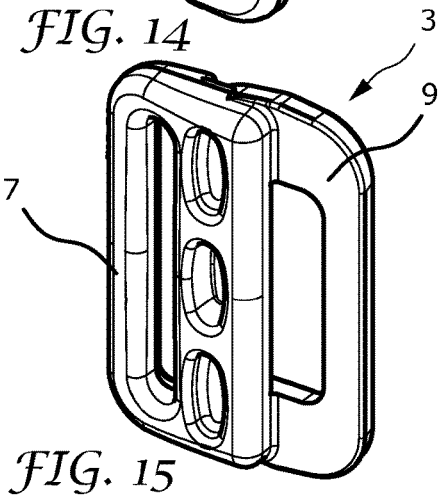
FIG. 15 is a rear perspective view of the female part.

FIGS. 17A & 17B are enlarged cross sectional views of the embodiments of male part 5 shown in FIGS. 11A & 11B, respectively, partially engaged with female part 3 of FIG. 16. In the embodiment of FIGS. 11B & 17B, exterior side 25 of connector plate 19 is dimensioned to interfere with leading side 27 of elongate aperture 11 when connector plate 19 is in the inclined orientation and positioned within open mouth 15. In contrast, in the embodiment of FIGS. 11A & 17A, exterior side 25 of connector plate 19 is dimensioned to not interfere with leading side 27 when male part 5 and female part 3 are being coupled.

The dimensioning of exterior side 25 to interfere with leading side 27 may be realized by decreasing the radius of curvature R of abutment edge 21 and correspondingly increasing the height H of inclined exterior side 25. For example, abutment edge 21 of the embodiment of FIG. 11B has a radius of 0.75 mm and exterior side 25 has a height of 0.65 mm. This dimensioning causes an interference with leading side 27 as shown in FIG. 17B. Male part 5 must be forcibly positioned into the substantially co-planar orientation with female part 3, and connector loop 9 resiliently receives connector plate 19 when the male base plate is forcibly positioned. For comparison in this example, abutment edge 21 of the embodiment of FIG. 11A has a radius of 1.1 mm and exterior side 25 has a height of 0.25 mm. This dimensioning does not cause an interference with leading side 27, as shown in FIG. 17A.

The dimensioning of connector plate 19 to interfere with connector loop 9 when coupling provides a second locking mechanism. A fastener 1 including both the interference dimensioning feature and the detent and socket feature has a double lock mechanism, whereby when female part 3 and male part 5 are coupled abutment edge 21 of the male must first be forced past the leading side 27 of the female and then, second, detent 41 is coupled with socket 43. When decoupling the male part from the female part, a force is applied to pivot the male away and decouple detent 41 from socket 43, then additional force must be applied to further pivot the male past the point of interference of abutment edge 21, then away from the female part. This decoupling process may cause two audible clicks, one heard upon the release of each locking mechanism.

Further provided is an embodiment of the fastener including the interference dimensioning feature, but without the detent and socket locking mechanism.

The embodiments of FIGS. 1-17 include openings 8 in each of male base plate 7 and female base plate 17. Openings 8 each receive the first or second garment piece 510, 520 (see FIG. 1). The garment piece is passed through opening 8 and attached back to itself, such as by sewing.

Figure 18:
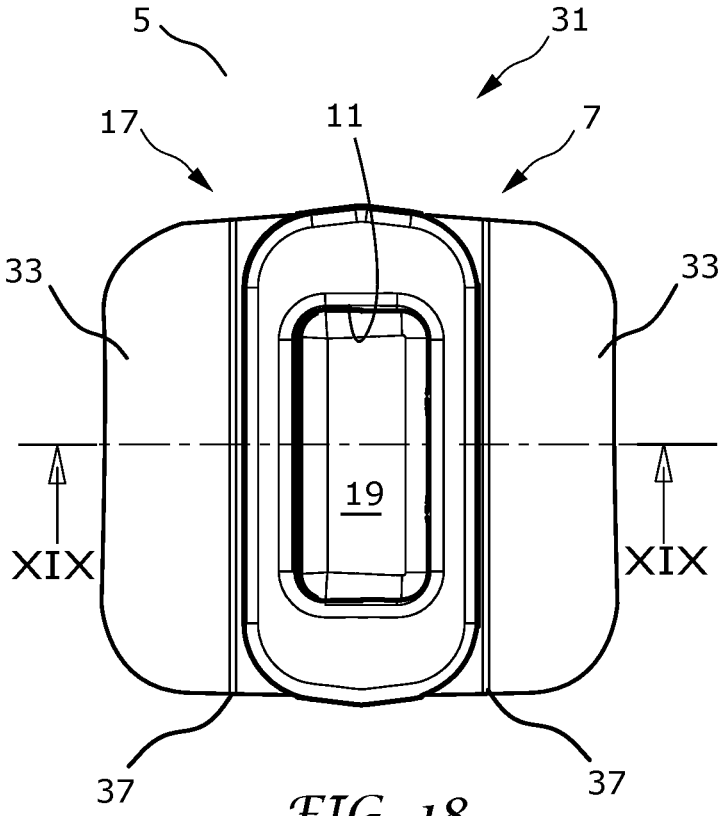
FIG. 18 is a front elevation view of another embodiment of the fastener.
Figure 19:
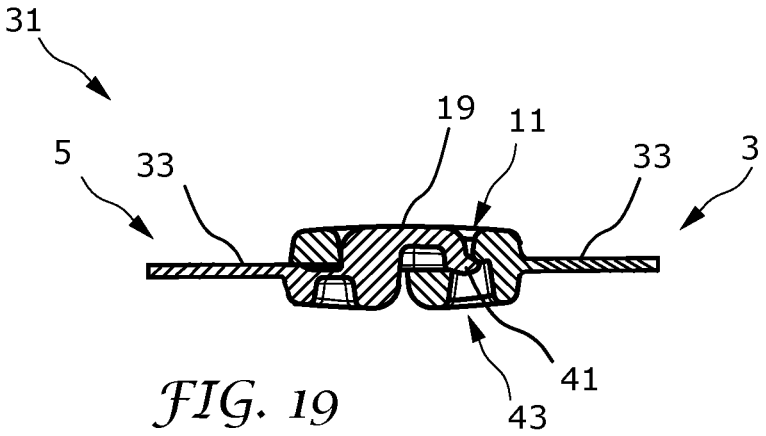
FIG. 19 is a cross sectional view along the line XIX-XIX of FIG. 18.

FIG. 18 is a front elevation view of another embodiment of the fastener, indicated generally by the reference numeral 31. FIG. 19 is a cross sectional view along the line XIX-XIX of FIG. 18. Fastener 31 is similar in many respects to fastener 1 in that it also has a recess 23 in male base plate 17 surrounding connector plate 19, and a locking mechanism including a detent 41 and socket 43. However, fastener 31 differs from fastener 1 in that female base plate 7 and male base plate 17 each include a flap 33 separated from the remainder of the base plates 7, 17 by a longitudinally extending hinge joint 37. Hinge joints 37 are formed by a recessed channel formed along the length of flap 33. The flaps are of the order of 0.7 mm deep and can be readily penetrated by a needle. In this way, the female part and the male part may be stitched directly onto a first garment piece and a second garment piece, respectively.

Various materials could be used to construct the fastener. One material that has been found to be effective, robust and capable of providing the structural integrity required is nylon.

Further provided is a garment including a fastener according to any of the embodiments described above.

The embodiments of the fastener described herein and garments incorporating same are exemplary and numerous modifications, combinations, variations, and rearrangements can be readily envisioned to achieve an equivalent result, all of which are intended to be embraced within the scope of the appended claims. Further, nothing in the above-provided discussions of the fastener and garment should be construed as limiting the invention to a particular embodiment or combination of embodiments. The scope of the invention is defined by the appended claims.

The invention claimed is:

1. A garment fastener for connecting a first garment piece and a second garment piece, the fastener comprising:

a female part comprising a female base plate for securing the female part to the first garment piece, and an overlapping connector loop mounted on the female base plate and offset relative thereto, the connector loop defining an elongate aperture therein, the aperture having a roofed portion which overlaps and is roofed in by the female base plate and an open mouth which extends beyond the female base plate;

a male part comprising a male base plate for securing the male part to the second garment piece, a connector plate mounted on the male base plate, offset relative thereto, and having a portion overlapped thereby, the connector plate having a rear face, a trailing abutment edge, and an interior side, the connector plate being dimensioned for insertion and retention in the elongate aperture in the female part, and a recess in the male base plate surrounding the portion of the connector plate overlapped by the male base plate;

the connector plate, the open mouth, and the elongate aperture of the connector loop being dimensioned so that insertion of the connector plate into the elongate aperture must be realized by positioning the male part at an inclined orientation relative to the female part before inserting the connector plate into the open mouth of the elongate aperture and bringing the male part and the female part together, retention of the connector plate in the elongate aperture of the connector loop being realized by snap fitting the connector plate in place by pivoting the fully inserted connector plate from the inclined orientation to a substantially co-planar orientation of the male base plate and the female base plate using the roofed portion of the aperture as a fulcrum until the abutment edge snaps into position in the aperture, and release of the connector plate from the aperture is realized by pivoting the inserted male part from the substantially co-planar orientation back to the inclined orientation using the roofed portion of the aperture as a fulcrum to release the abutment edge from the aperture before moving the male part and the female part apart;

the connector plate having a detent protruding from the interior side; and, the female part having a socket configured to receive the detent when the male part and the female part are pivoted to a substantially co-planar orientation, thereby locking the male part to the female part.

2. The fastener of claim 1, further including:

the detent being centrally located on the interior side of the connector plate and protruding away from the male base plate along a portion of the interior side adjacent the rear face;

the elongate aperture having a roofed edge where the connector loop overlaps the female base plate; and, the socket being coincident with the roofed edge and extending forward into the connector loop, the portion of the connector loop forward of the socket configured to retain the detent within the socket.

3. The fastener of claim 1, further including:

a cavity in the rear face of the connector plate, the cavity adjacent the detent and opening toward the male base plate.

4. The fastener of claim 1, further including:

two notches in the interior side of the connector plate, one notch located above and adjacent to the detent and one notch located below and adjacent to the detent, the notches extending forward from the rear face.

5. The fastener of claim 1, further including:

the elongate aperture having a leading side which is inclined toward the female base plate, so that the open mouth narrows toward the female base plate;

the connector plate having an exterior side intermediate the abutment edge and the male base plate, the exterior side inclined away from the male base plate, so that the connector plate narrows toward the male base plate;

the exterior side of the connector plate dimensioned to interfere with the leading side of the elongate aperture when the connector plate is in the inclined orientation and positioned within the open mouth; and, the connector loop configured to resiliently receive the connector plate when the male base plate is forcibly positioned into the substantially co-planar orientation with the female base plate.

6. The fastener of claim 1 wherein each of the male base plate and the female base plate has an opening for reception of the first or second garment piece.

7. The fastener of claim 1 wherein each of the male base plate and the female base plate includes a longitudinally extending hinge joint.

8. The fastener of claim 1, further including:

the detent being centrally located on the interior side of the connector plate and protruding away from the male base plate along a portion of the interior side adjacent the rear face;

the elongate aperture having a roofed edge where the connector loop overlaps the female base plate;

the socket being coincident with the roofed edge and extending forward into the connector loop, the portion of the connector loop forward of the socket configured to retain the detent within the socket;

a cavity in the rear face of the connector plate, the cavity adjacent the detent and opening toward the male base plate;

two notches in the interior side of the connector plate, one notch located above and adjacent to the detent and one notch located below and adjacent to the detent, the notches extending forward from the rear face;

the elongate aperture having a leading side which is inclined toward the female base plate, so that the open mouth narrows toward the female base plate;

the connector plate having an exterior side intermediate the abutment edge and the male base plate, the exterior side inclined away from the male base plate, so that the connector plate narrows toward the male base plate;

the exterior side of the connector plate dimensioned to interfere with the leading side of the elongate aperture when the connector plate is in the inclined orientation and positioned within the open mouth; and, the connector loop configured to resiliently receive the connector plate when the male base plate is forcibly positioned into the substantially co-planar orientation with the female base plate.

9. The fastener of claim 8 wherein each of the male base plate and the female base includes a longitudinally extending hinge joint.

10. A garment fastener for connecting a first garment piece and a second garment piece, the fastener comprising:

a female part comprising a female base plate for securing the female part to the first garment piece, and an overlapping connector loop mounted on the female base plate and offset relative thereto, the connector loop defining an elongate aperture therein, the aperture having a roofed portion which overlaps and is roofed in by the female base plate and an open mouth which extends beyond the female base plate;

a male part comprising a male base plate for securing the male part to the second garment piece, a connector plate mounted on the male base plate, offset relative thereto, and having a portion overlapped thereby, the connector plate having a rear face, a trailing abutment edge, and an interior side, the connector plate being dimensioned for insertion and retention in the elongate aperture in the female part, and a recess in the male base plate surrounding the portion of the connector plate overlapped by the male base plate;

the connector plate, the open mouth, and the elongate aperture of the connector loop being dimensioned so that insertion of the connector plate into the elongate aperture must be realized by positioning the male part at an inclined orientation relative to the female part before inserting the connector plate into the open mouth of the elongate aperture and bringing the male part and the female part together, retention of the connector plate in the elongate aperture of the connector loop being realized by snap fitting the connector plate in place by pivoting the fully inserted connector plate from the inclined orientation to a substantially co-planar orientation of the male base plate and the female base plate using the roofed portion of the aperture as a fulcrum until the abutment edge snaps into position in the aperture, and release of the connector plate from the aperture is realized by pivoting the inserted male part from the substantially co-planar orientation back to the inclined orientation using the roofed portion of the aperture as a fulcrum to release the abutment edge from the aperture before moving the male part and the female part apart;

the elongate aperture having a leading side which is inclined toward the female base plate, so that the open mouth narrows toward the female base plate;

the connector plate having an exterior side intermediate the abutment edge and the male base plate, the exterior side inclined away from the male base plate, so that the connector plate narrows toward the male base plate;

the exterior side of the connector plate dimensioned to interfere with the leading side of the elongate aperture when the connector plate is in the inclined orientation and positioned within the open mouth; and, the connector loop configured to resiliently receive the connector plate when the male base plate is forcibly positioned into the substantially co-planar orientation with the female base plate.

11. The fastener of claim 10 wherein each of the male base plate and the female base plate has an opening for reception of the first or second garment piece.

12. The fastener of claim 10 wherein each of the male base plate and the female base includes a longitudinally extending hinge joint.

13. A garment including the fastener of claim 1.

14. A garment including the fastener of claim 8.

15. A garment including the fastener of claim 10.

* * * * *